US012741231B2

(12) United States Patent
Clagett et al.

(10) Patent No.: US 12,741,231 B2
(45) Date of Patent: Sep. 22, 2026

(54) SWIMMING START BLOCK WITH SLIDABLE TRACK START WEDGE

(71) Applicant: Everlast Climbing Industries, Inc., Crystal, MN (US)

(72) Inventors: Shane Russell Clagett, Lakeville, MN (US); John Lucas Florin, Missoula, MT (US)

(73) Assignee: EVERLAST CLIMBING INDUSTRIES, INC., Crystal, MN (US)

( * ) Notice: Subject to any disclaimer, the term of this patent is extended or adjusted under 35 U.S.C. 154(b) by 143 days.

(21) Appl. No.: 18/908,325

(22) Filed: Oct. 7, 2024

(65) Prior Publication Data

US 2026/0097330 A1 Apr. 9, 2026

(51) Int. Cl.
*A63K 3/02* (2006.01)

(52) U.S. Cl.
CPC ..... *A63K 3/023* (2013.01)

(58) Field of Classification Search
CPC ..... A63K 3/023
USPC ..... 4/496
See application file for complete search history.

(56) References Cited

U.S. PATENT DOCUMENTS

| | | | | |
|---|---|---|---|---|
| 11,229,826 | B1 * | 1/2022 | Klein | A63K 3/02 |
| 2013/0252788 | A1 * | 9/2013 | Kaiel | A63B 69/12 482/55 |
| 2019/0366227 | A1 * | 12/2019 | Henry | F16H 31/002 |
| 2020/0197738 | A1 * | 6/2020 | Svendsen | A63K 3/023 |
| 2023/0117056 | A1 * | 4/2023 | Grasso | E04H 4/14 4/496 |

* cited by examiner

*Primary Examiner* — Huyen D Le
(74) *Attorney, Agent, or Firm* — McAndrews, Held & Malloy, Ltd.

(57) ABSTRACT

A swimming start block assembly having an adjustable track start wedge is disclosed. The track start wedge is slidable forward and rearward along an upper surface of a swimming start block and is lockable at a desired position by inserting locking tabs positioned at each side of the track start wedge into a set of apertures positioned along each side of the start block. The track start wedge may be spring-loaded toward a locked position and the assembly may be configured so that the locking tabs are received by apertures regardless of whether they are aligned when the wedge is released from an unlocked position.

19 Claims, 17 Drawing Sheets

SWIMMING START BLOCK WITH SLIDABLE TRACK START WEDGE

BACKGROUND

In many competitive swimming events, each swimmer begins the race by jumping into his or her lane of the pool from an elevated start block that is mounted next to one end of the pool. Often the swimmer starts from a track start position in which one foot is placed toward the front edge of the start block and the other foot is placed further back on the start block on an angled wedge, known as a track start wedge.

Some swimming start blocks have adjustable track start wedges in which a user lifts the track start wedge out of a set of apertures in the swimming start block and places it in a desired position, either closer to the front edge of the start block or farther from the front edge of the start block, depending on the swimmer's height and personal preferences. These track start wedges can be difficult to adjust and are subject to use without the track start wedge actually being locked in place. Further, because gravity is the only force holding the track start wedge in place, even when properly locked in place, the track start wedge can be wobbly, which can be particularly problematic as a user is pushing off the wedge to start a race.

SUMMARY OF THE INVENTION

The present disclosure is directed to an improved starting block for competitive swimming events and more particularly to a starting block having a improved assembly for adjusting the position of a track start wedge and locking the track start wedge in a desired position for use. In contrast to conventional swimming start blocks, the track start wedge of embodiments of the present disclosure easily slide along a track and are spring-biased into a locked position to provide enhanced stability during use.

Embodiments of the present disclosure are directed to a swimming start assembly that includes a starting block having an upper surface on which a swimmer may stand at the start of a competitive swimming event, e.g. race. In addition to the upper surface, the starting block includes a front edge, a rear edge, a first side edge, and a second side edge. The assembly further includes a track start wedge that is slidable in a frontward and rearward direction along the upper surface of the starting block and lockable in place at a plurality of distances from the front edge to suit a swimmer's height and personal preferences.

The upper surface comprises, along each of the first and second sides, a plurality of apertures aligned along an axis running between the front edge and the rear edge of the starting block. Each of the plurality of apertures is configured to receive a locking tab of the adjustable track start wedge. The upper surface also comprises, along each of the first and second sides, a track along which a carriage of the adjustable track start wedge is configured to slide.

The adjustable track start wedge comprises an angled front surface configured for the swimmer to place one of his/her feet at the start of a competitive swimming event, e.g. race. The adjustable track start wedge also includes, along each of its sides, a carriage configured to slide along the associated track of the swimming start block in a frontward and rearward direction. The adjustable track start wedge also includes, along each of its sides, a locking tab configured to prevent movement of the track start wedge when inserted into and received by one of the plurality of apertures in the upper surface of the swimming start block.

The adjustable track start wedge may comprise a vertically fixed element and a vertically movable element. The vertically movable element includes the locking tabs and the vertically fixed element includes or is attached to the carriage. The vertically movable element is pivotably connected to the vertically fixed element at an end opposite the locking tabs, such that the vertically movable element can be pivoted (i) upward to remove the locking tabs from the apertures along each side of the swimming start block and thereby allow for sliding of the track start wedge in a frontward or rearward direction or (ii) downward to position the locking tabs in the apertures and thereby lock the track start wedge in place at a desired position along the front to rear axis.

The assembly may be configured so that the adjustable track start wedge is spring biased, also referred to as spring loaded, toward a locked position. In some embodiments, for instance, the vertically movable element may be spring-loaded toward the downward position. Where spring loaded, the assembly may be configured so that each of the locking tabs is received by one of the apertures regardless of whether the locking tabs of the adjustable track start wedge are aligned with a set of apertures when rotation to the locked position begins. This may achieved, for example, through the force of the spring loading (and the spacing of the apertures). It may also be facilitated by the locking tabs having tapered front and/or rear edges that operate to guide the tab into an aperture when the spring loading brings it into contact with a surface adjacent that aperture.

In some embodiments, the angled front surface of the track start wedge may be part of the vertically fixed element, in which case the vertically movable element may be a bar or the like which may be positioned so as not to interfere with use of the wedge by a swimmer to start a race, e.g. beneath the angled front surface. In such embodiments, a swimmer may grasp and lift the bar in order to bring the track start wedge to an unlocked position and then may pull or push the bar in the forward or rearward direction, thereby sliding the track start wedge in the intended direction, until a desired position is reached. To bring the track start wedge to a locked position, the swimmer may then either lower the bar, or where the track start wedge is spring biased to a locked position as in embodiments of the present disclosure, simply release the bar. In some embodiments, the bar may include one or more lift tabs that facilitate use in this manner.

In other embodiments, the angled front surface may itself be part of the vertically movable element. In such embodiments, for instance, the vertically movable element may include substantially the entire outer body of the track start wedge. In such an embodiment, therefore, a swimmer may grasp the top-rear edge of the angled front surface and rotate it upward/forward in order to bring the track start wedge to an unlocked position. The swimmer may then pull or push the bar in the forward or rearward direction, thereby sliding the track start wedge in the intended direction, until a desired position is reached. To bring the track start wedge to a locked position, the swimmer may then either rotate the angled front surface downward/rearward, or where the track start wedge is spring biased to a locked position as in embodiments of the present disclosure, simply release the wedge entirely, with the spring biasing the wedge back down into a locked position.

In some embodiments, each carriage may include an upper element that is positioned above the track on which it slides and a lower element positioned below the track on which it slides. By having elements positioned above and below the track, undesired up-and-down movement of the track start wedge is reduced. Similarly, a side surface of the lower element of each carriage may contact a surface, such as a plate, to limit side-to-side movement of the carriage, thereby reducing undesired side-to-side movement of the track start wedge.

In some embodiments, the track and the plurality of apertures may be part of a surface element that is affixed to the swimming start block, and more particularly to the upper surface of the starting block along each of the first and second sides. In such an embodiment, the upper surface of the starting block may include, along each of the first and second sides, an opening configured to at least partially receive the surface element. This arrangement may facilitate easy installation of the track start wedge. Where the swimming start block were intended for use without the track start wedge, the surface element could be installed without the carriage or a different surface element (e.g. one without apertures) could be installed in its place.

The swimming starting block assembly of embodiments of the present disclosure may be configured to that the track start wedge is not physically removed from the starting block when adjusting its position. Moreover, in some embodiments, the swimming starting block assembly of embodiments of the present disclosure may be configured so that the adjustable track start wedge is lockable in at least six different positions.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
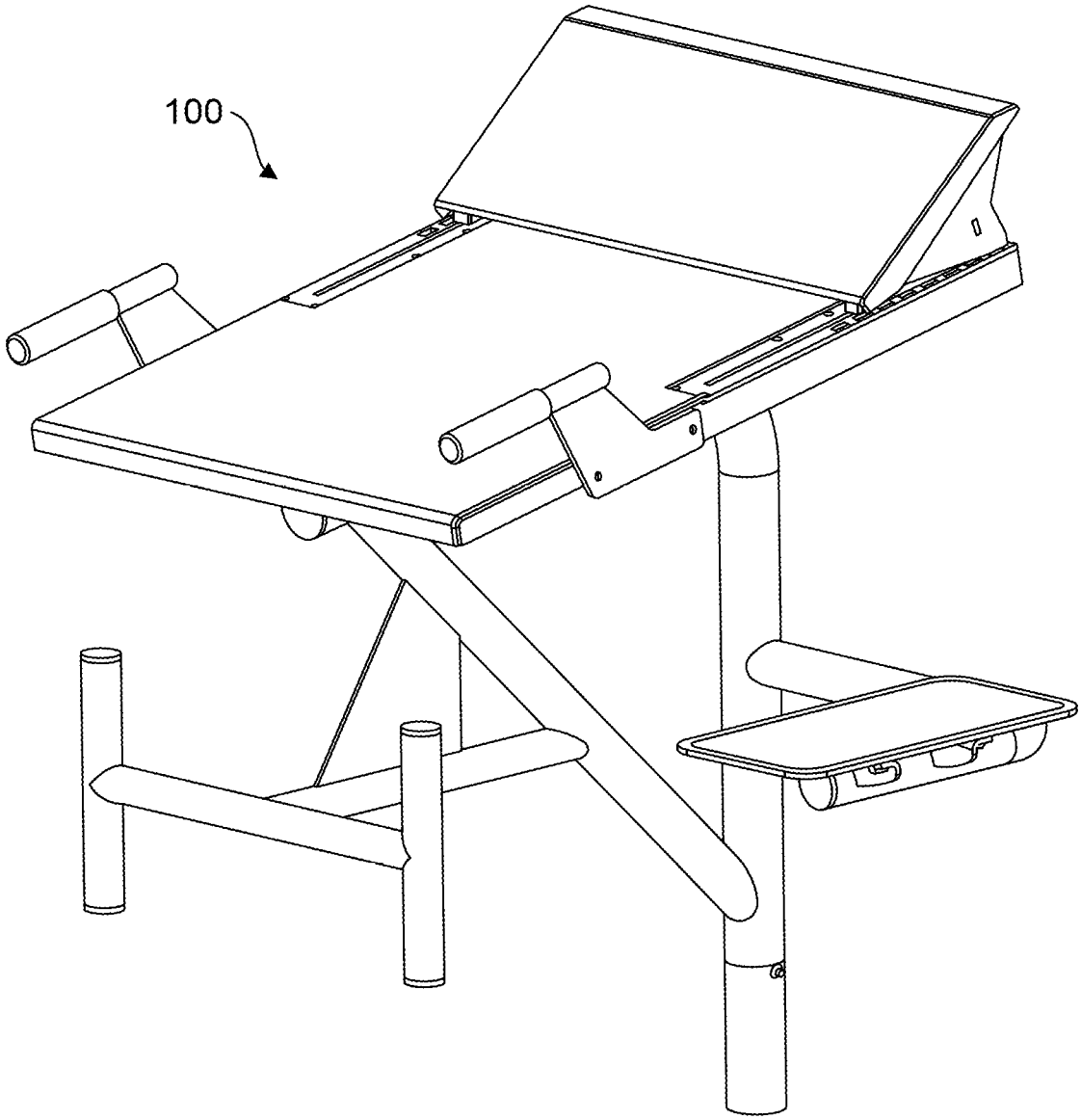
FIG. 1 is a front perspective view of a swimming start block assembly of an embodiment of the present disclosure, with a typical mounting assembly.
Figure 2:
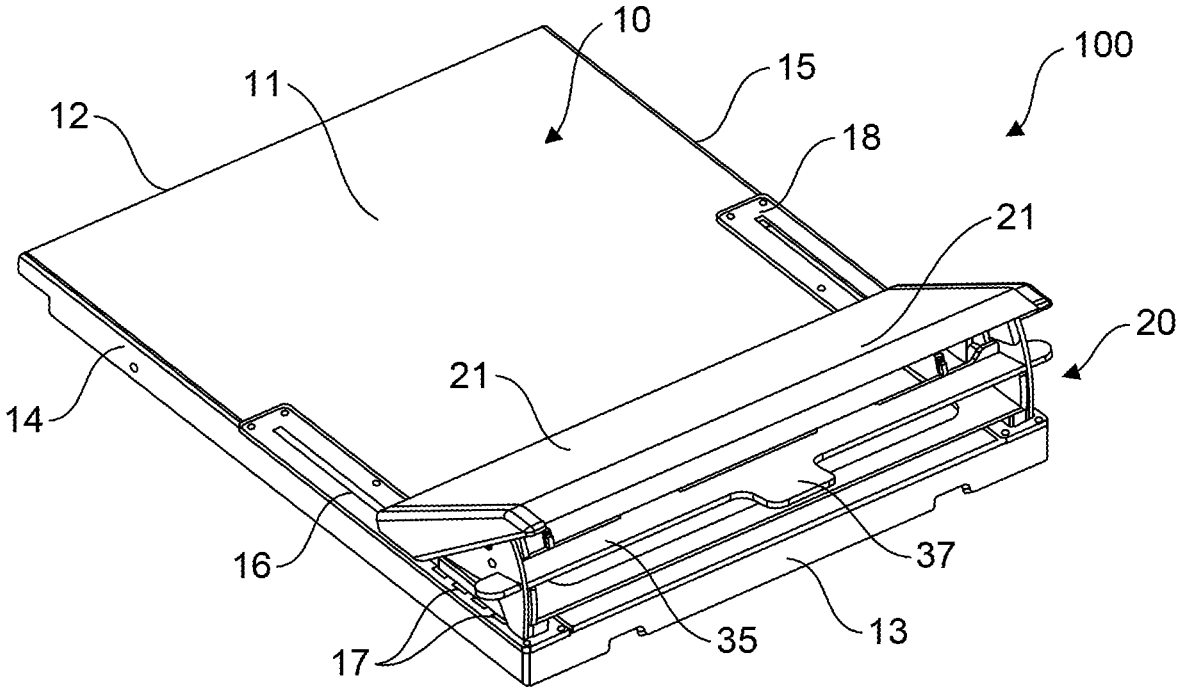
FIG. 2 is a top, rear perspective view of a first embodiment of a swimming start block assembly of the present disclosure, showing the adjustable track start wedge in a locked position.
Figure 3:
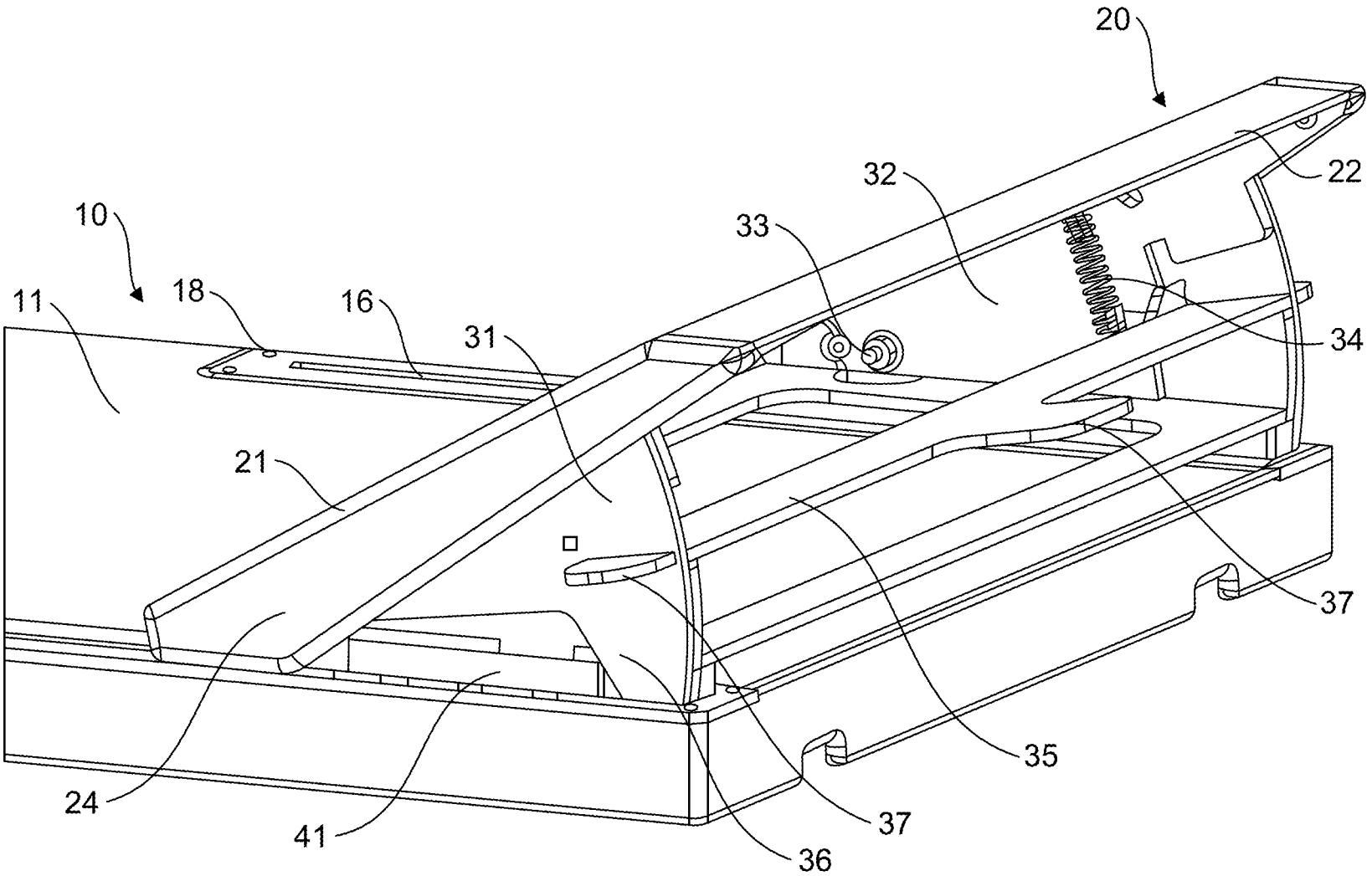
FIG. 3 is a side, rear perspective of the embodiment illustrated in FIG. 2, showing the adjustable track start wedge in a locked position.
Figure 4:
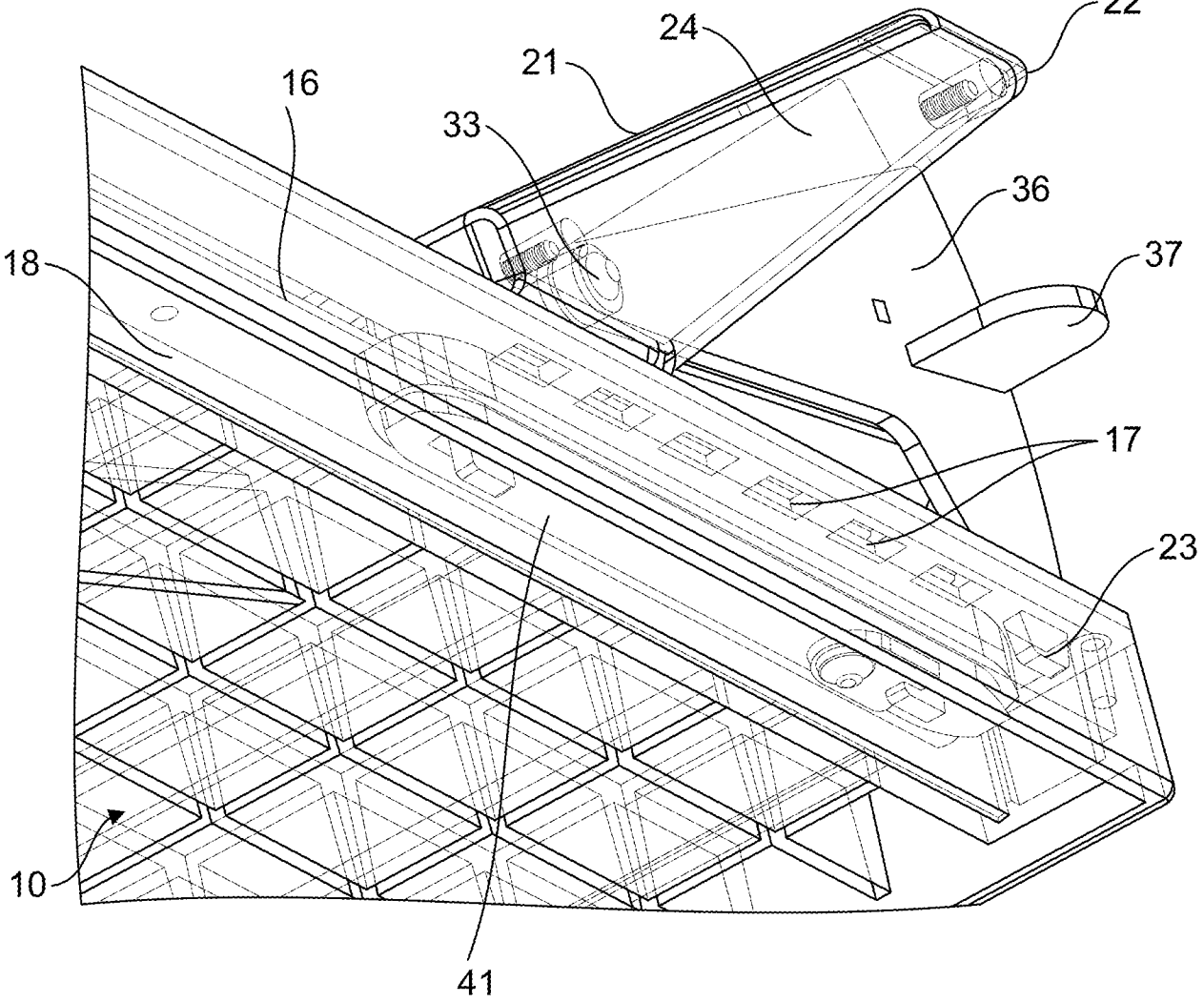
FIG. 4 is a bottom, side perspective view, in partial cross-section, of the embodiment illustrated in FIG. 2, showing the adjustable track start wedge in a locked position.
Figure 5:
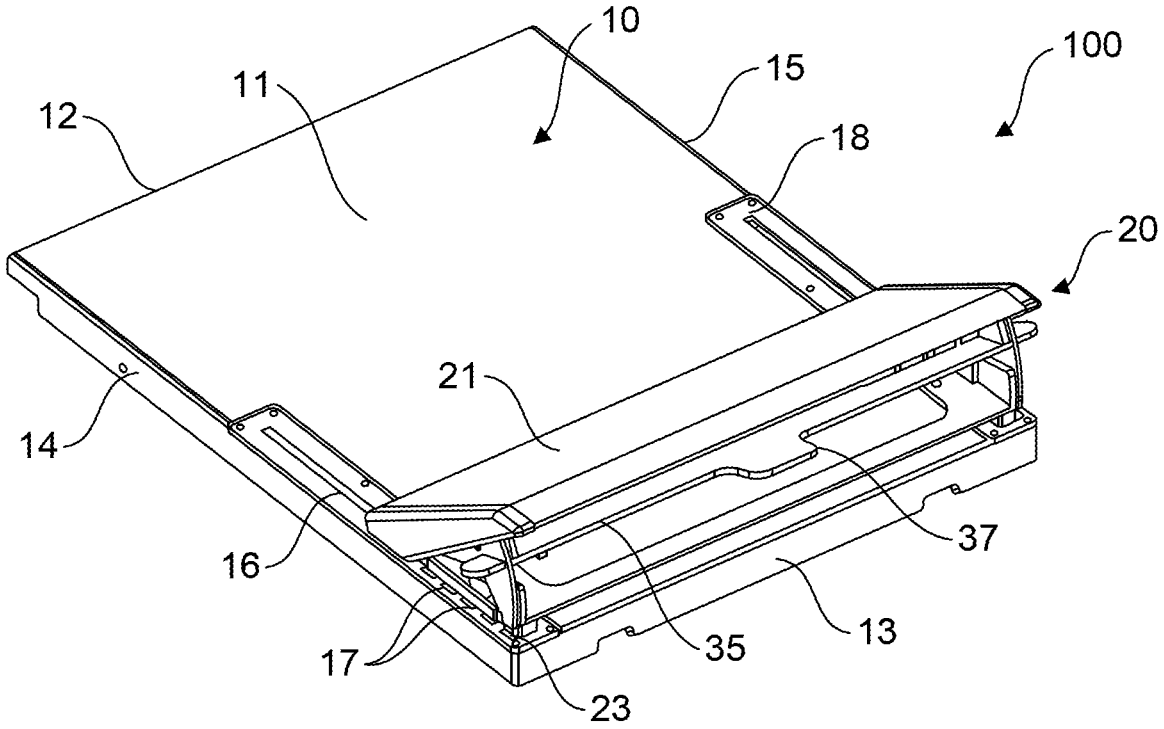
FIG. 5 is a top, rear perspective view of the embodiment illustrated in FIG. 2, showing the adjustable track start wedge in an unlocked position.
Figure 6:
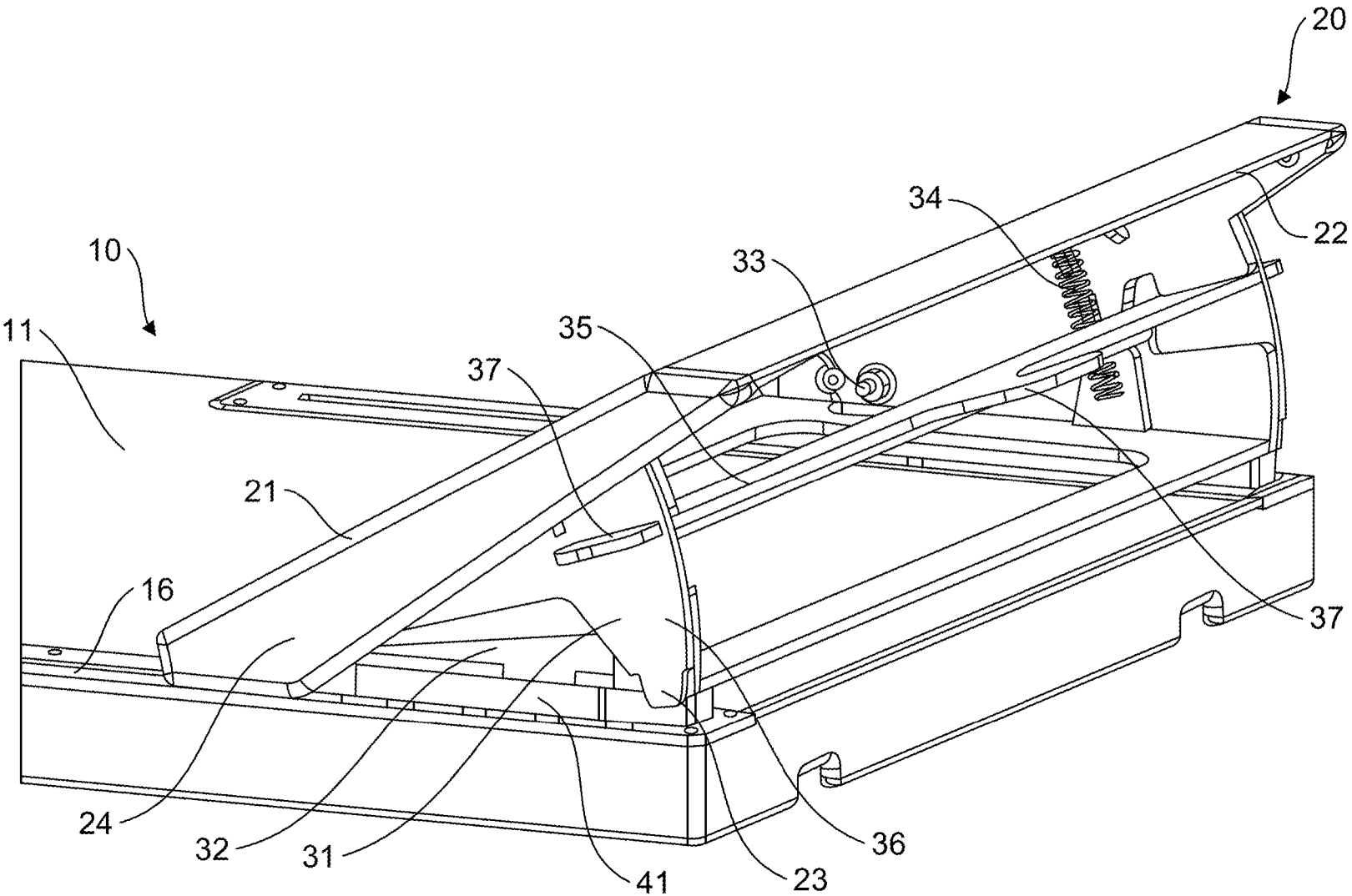
FIG. 6 is a side, rear perspective view of the embodiment illustrated in FIG. 2, showing the adjustable track start wedge in an unlocked position.
Figure 7:
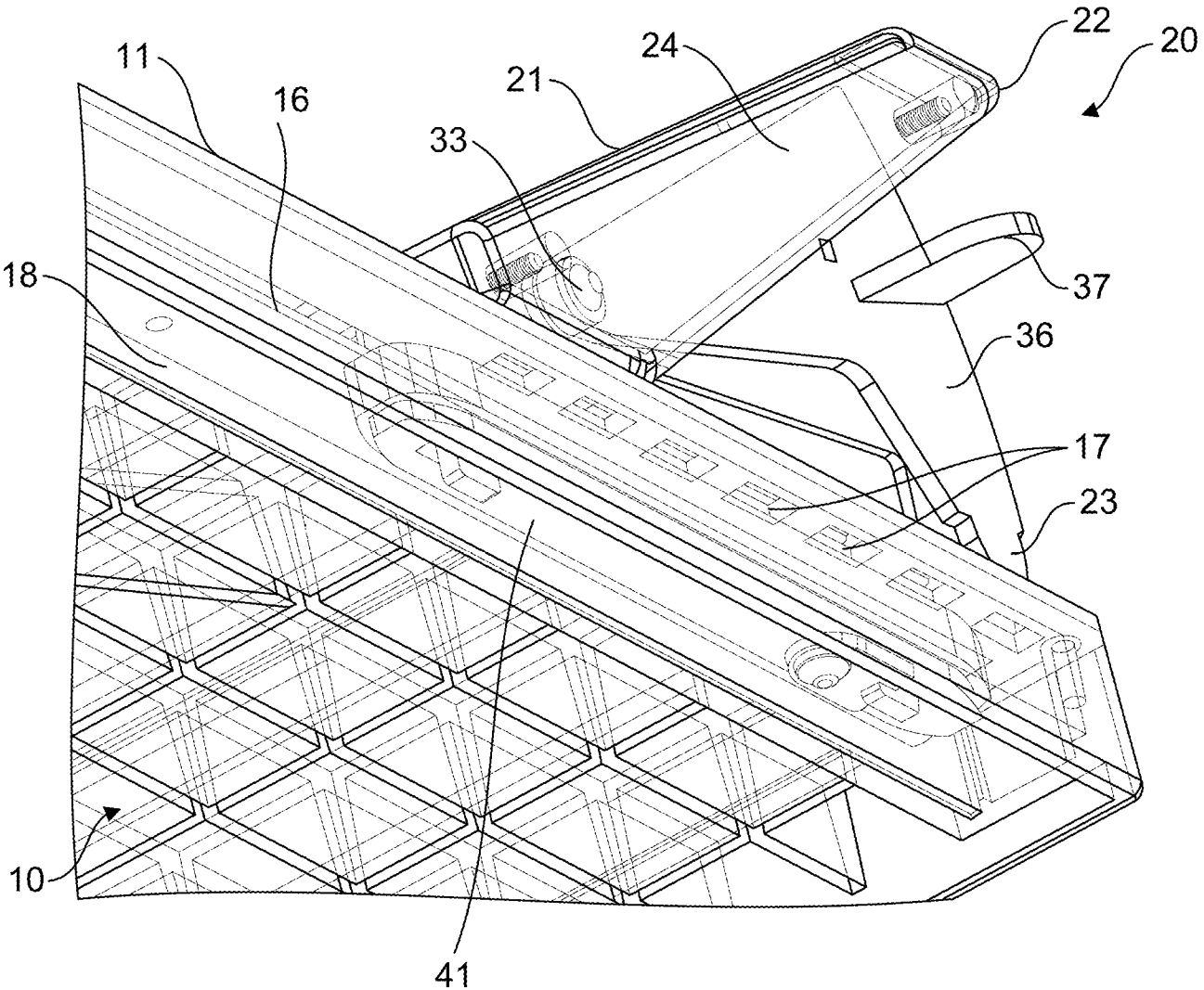
FIG. 7 is a bottom, side perspective view, in partial cross-section, of the embodiment illustrated in FIG. 2, showing the adjustable track start wedge in an unlocked position.
Figure 8:
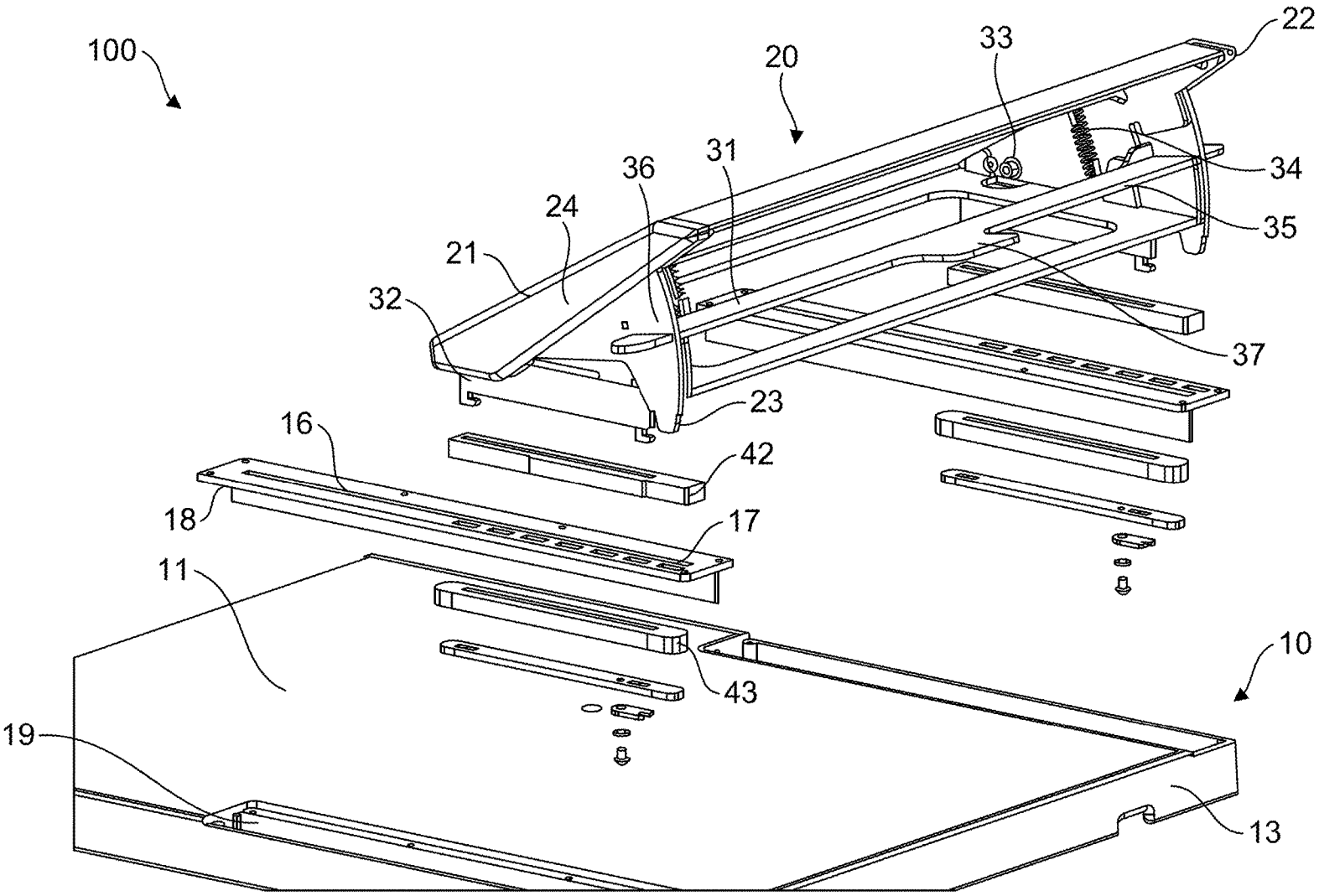
FIG. 8 is an exploded side, rear perspective view of the embodiment illustrated in FIG. 2, showing the various components by which the adjustable track start wedge is connected to the swimming start block.
Figure 9:
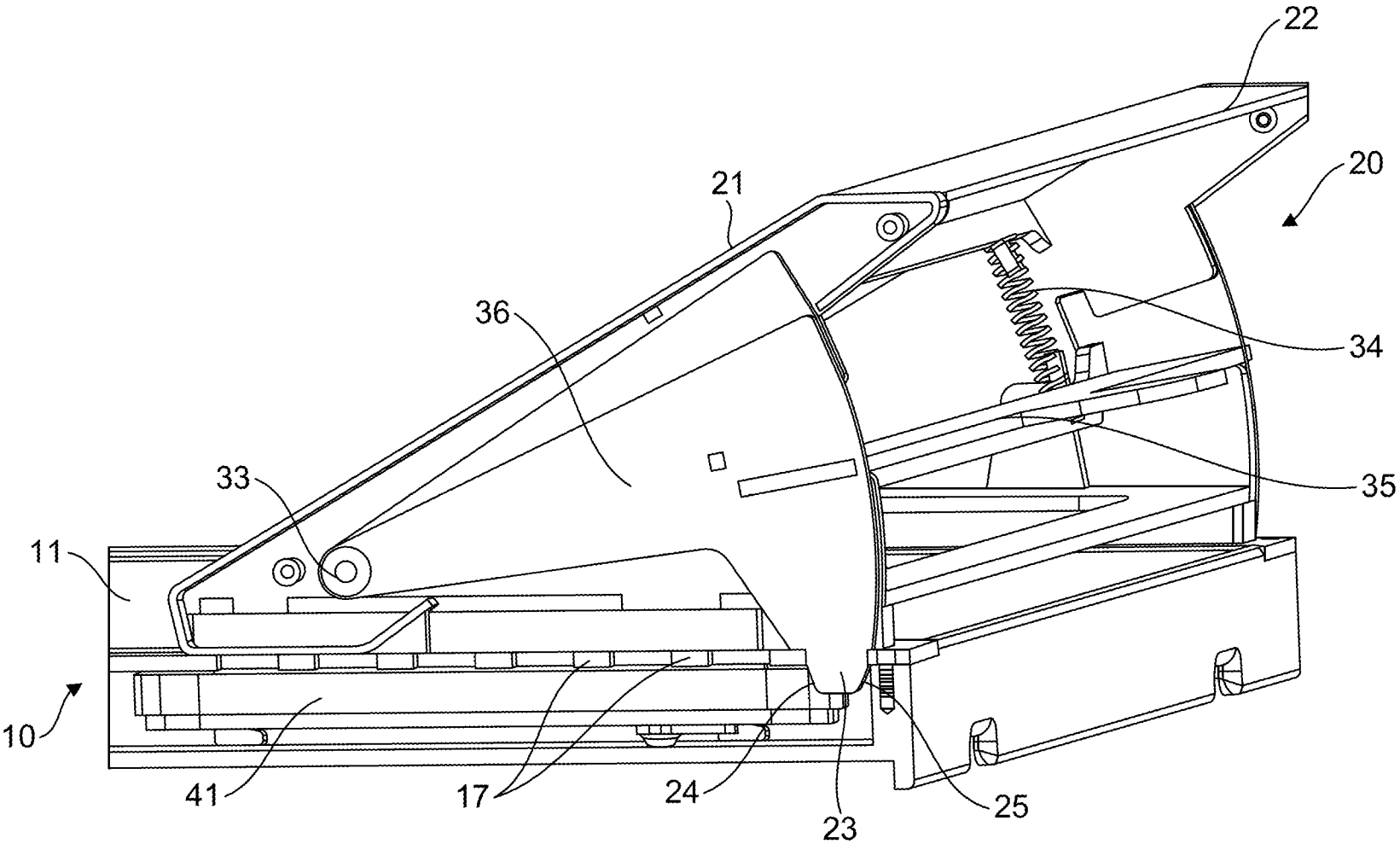
FIG. 9 is a side perspective view, in partial cross-section, of the embodiment illustrated in FIG. 2, showing the adjustable track start wedge in a locked position.
Figure 10:
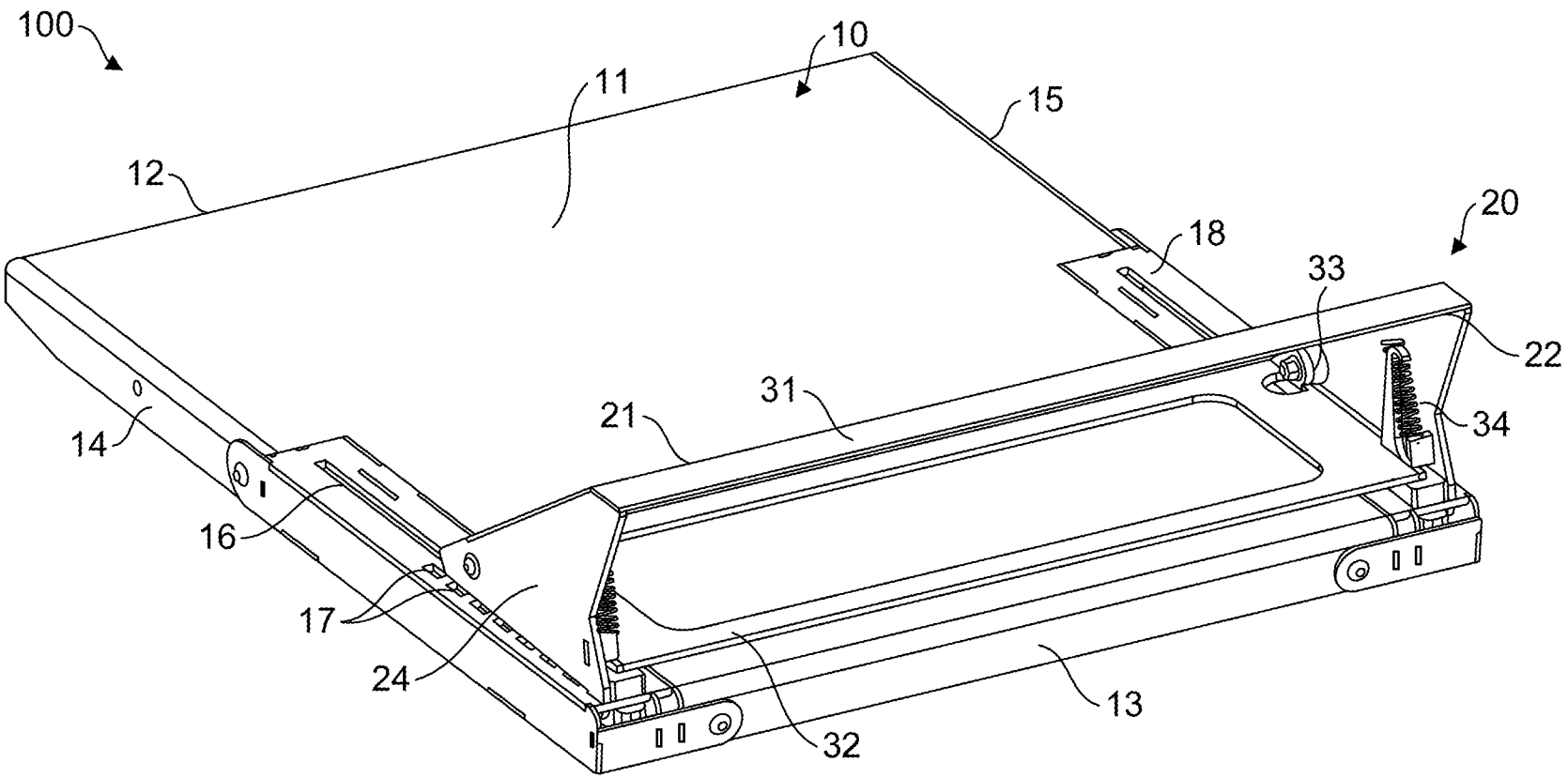
FIG. 10 is a top, rear perspective view of a second embodiment of a swimming start block assembly of the present disclosure, showing the adjustable track start wedge in a locked position.
Figure 11:
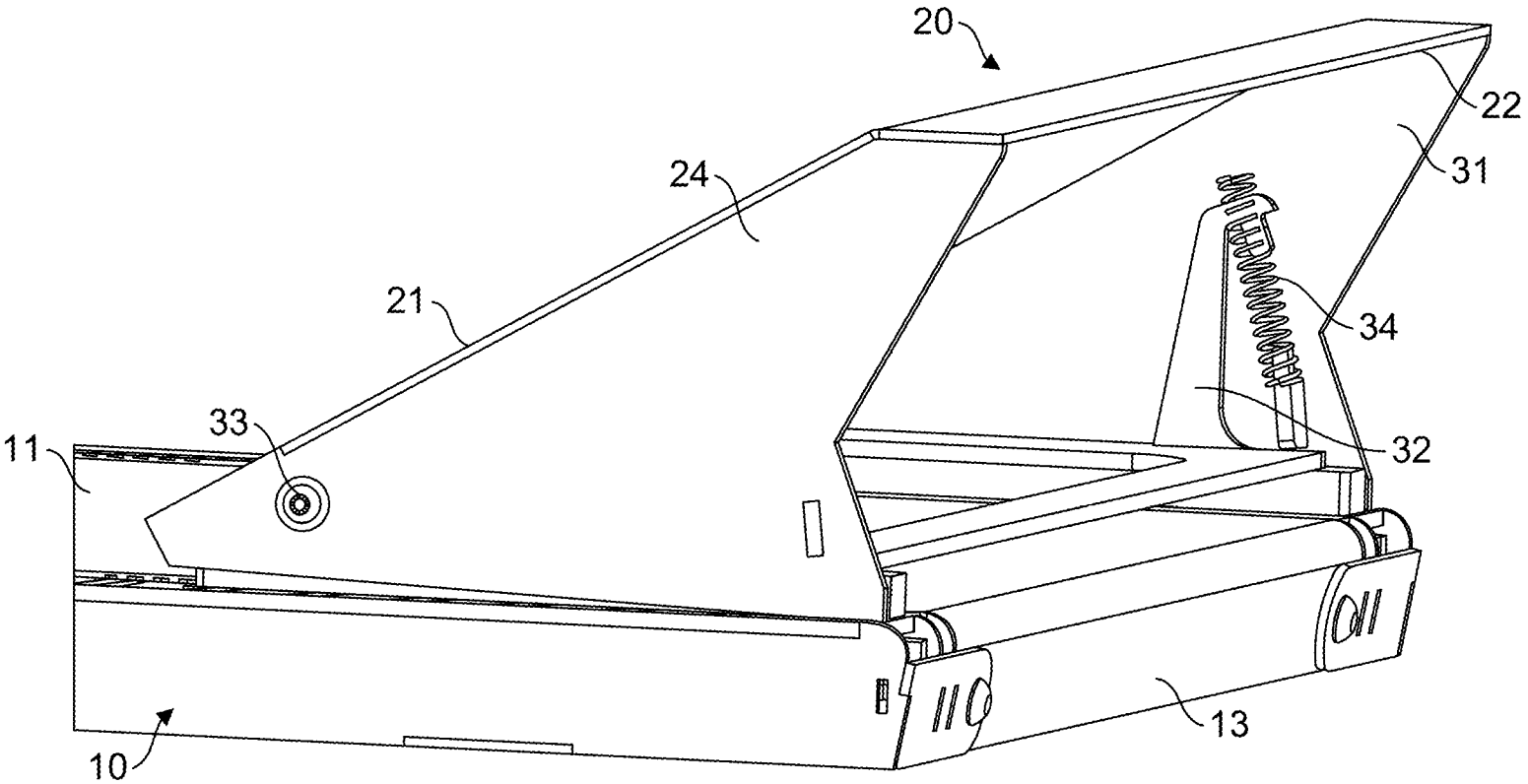
FIG. 11 is a side, rear perspective of the embodiment illustrated in FIG. 10, showing the adjustable track start wedge in a locked position.
Figure 12:
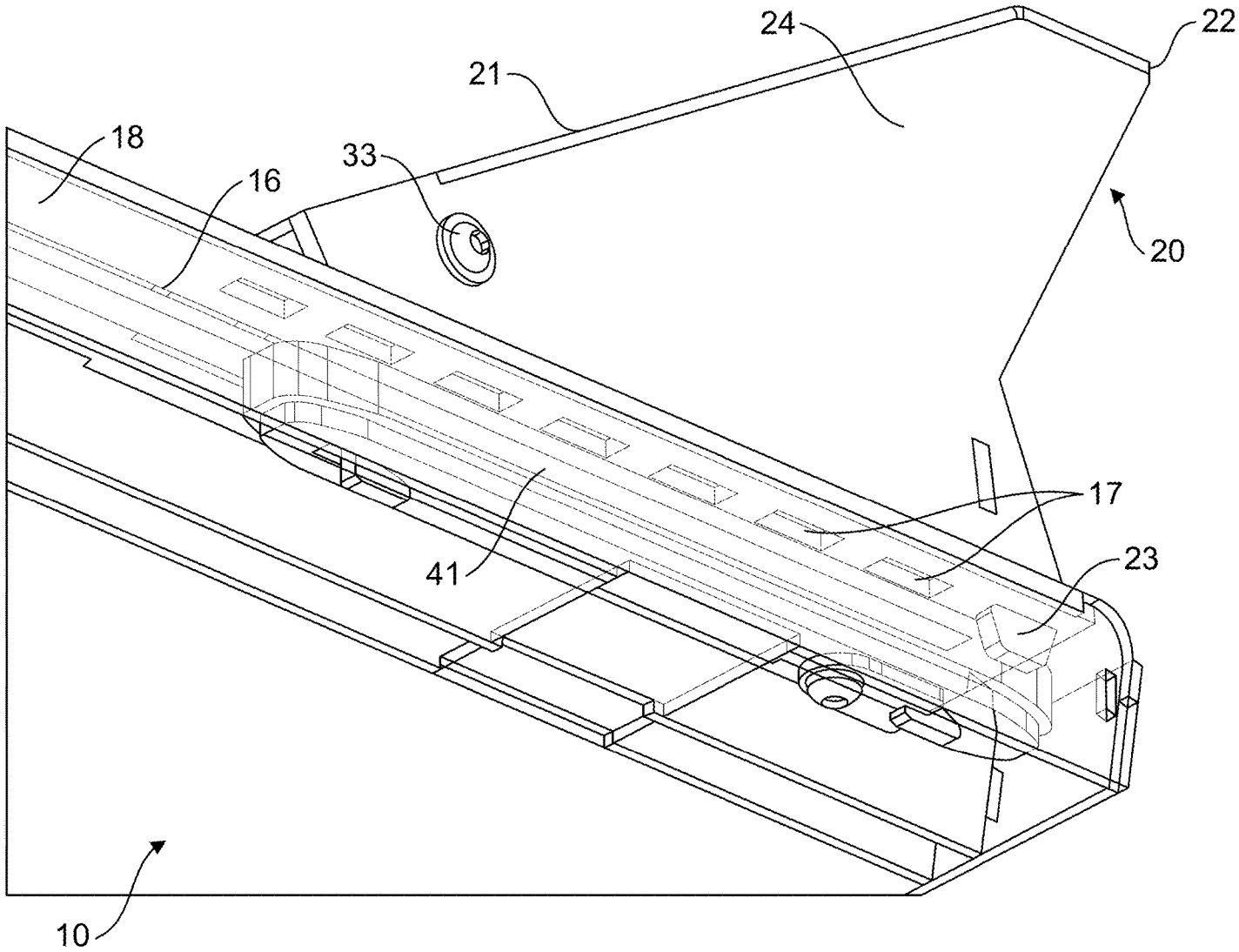
FIG. 12 is a bottom, side perspective view, in partial cross-section, of the embodiment illustrated in FIG. 10, showing the adjustable track start wedge in a locked position.
Figure 13:
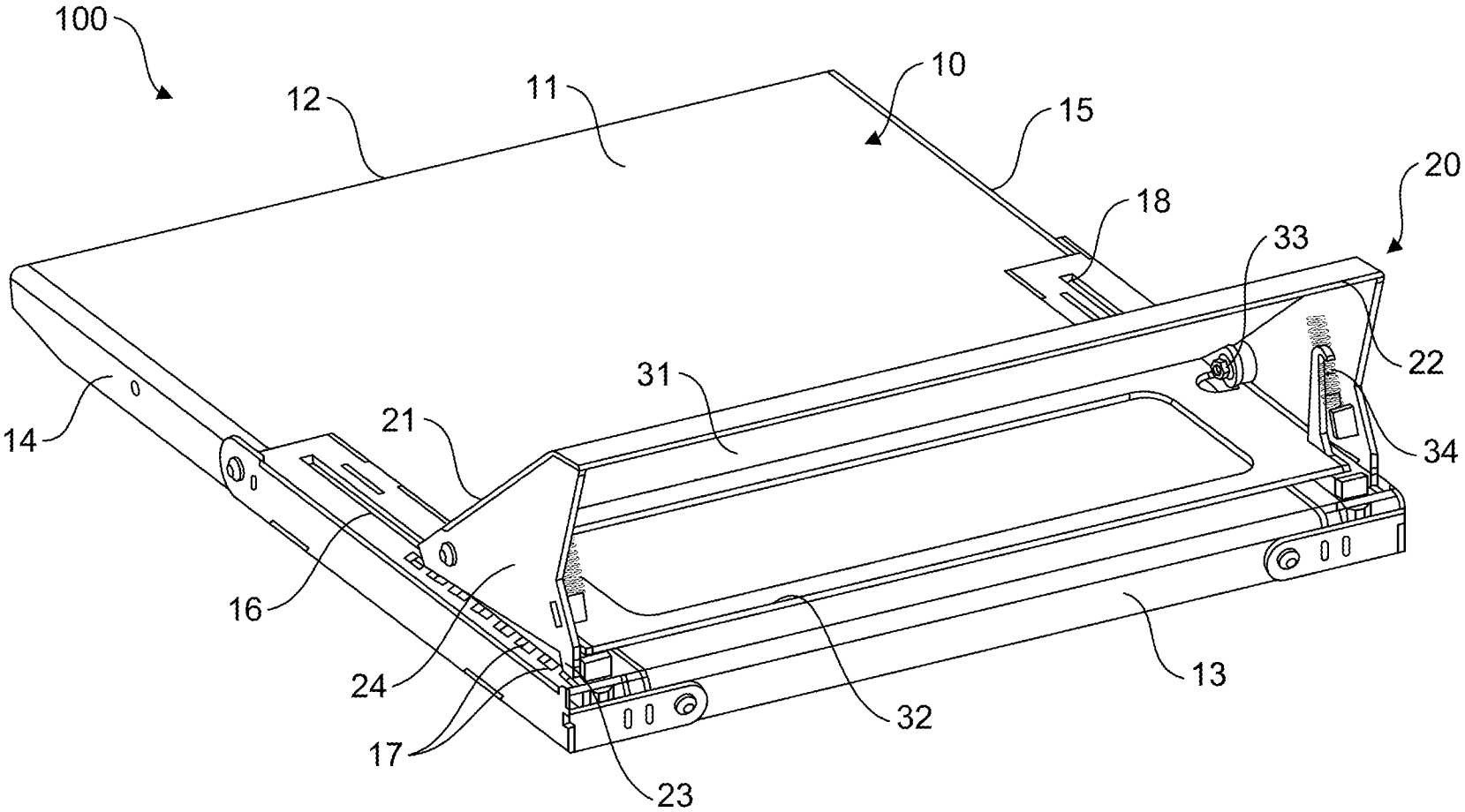
FIG. 13 is a top, rear perspective view of the embodiment illustrated in FIG. 10, showing the adjustable track start wedge in an unlocked position.
Figure 14:
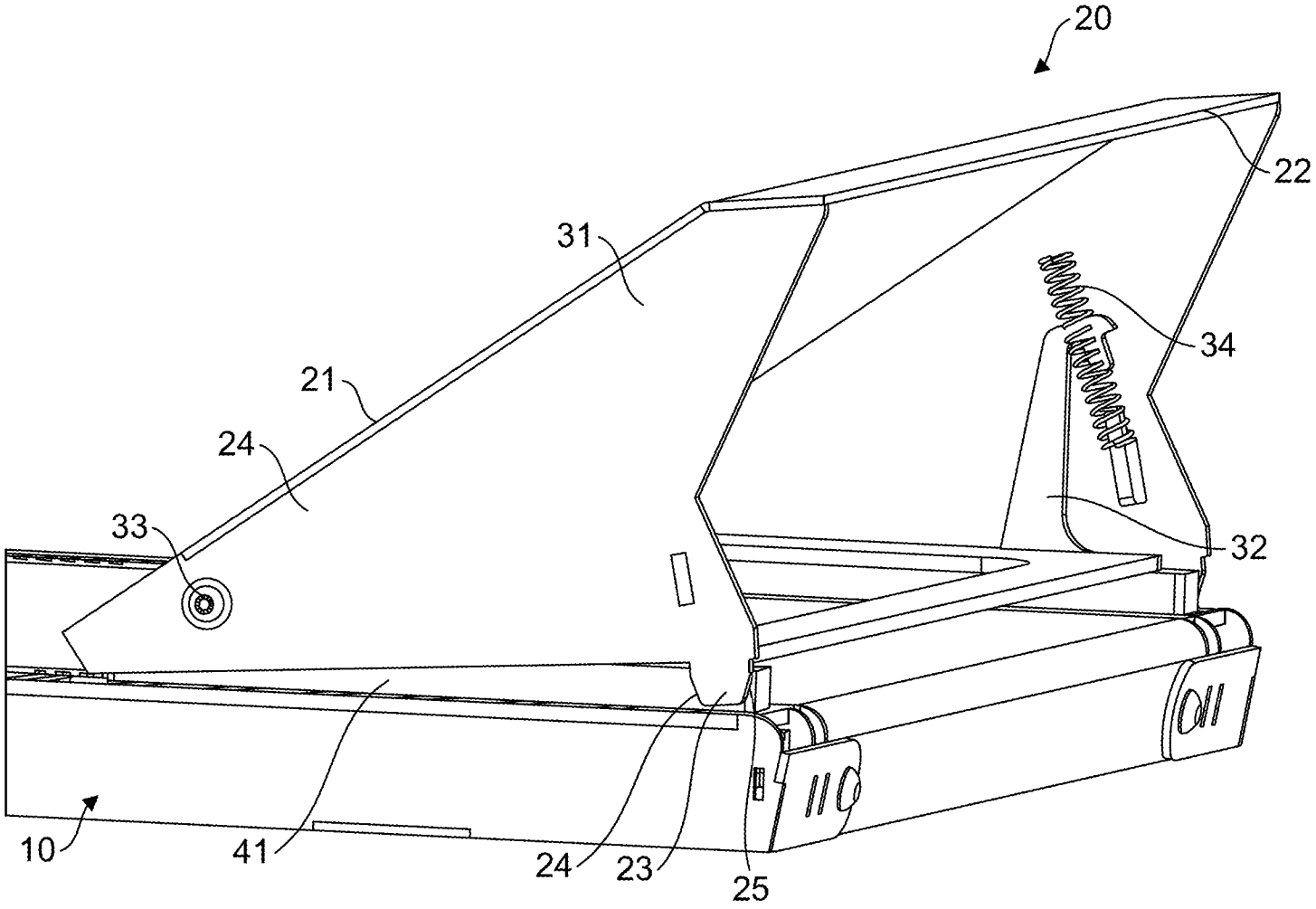
FIG. 14 is a side, rear perspective view of the embodiment illustrated in FIG. 10, showing the adjustable track start wedge in an unlocked position.
Figure 15:
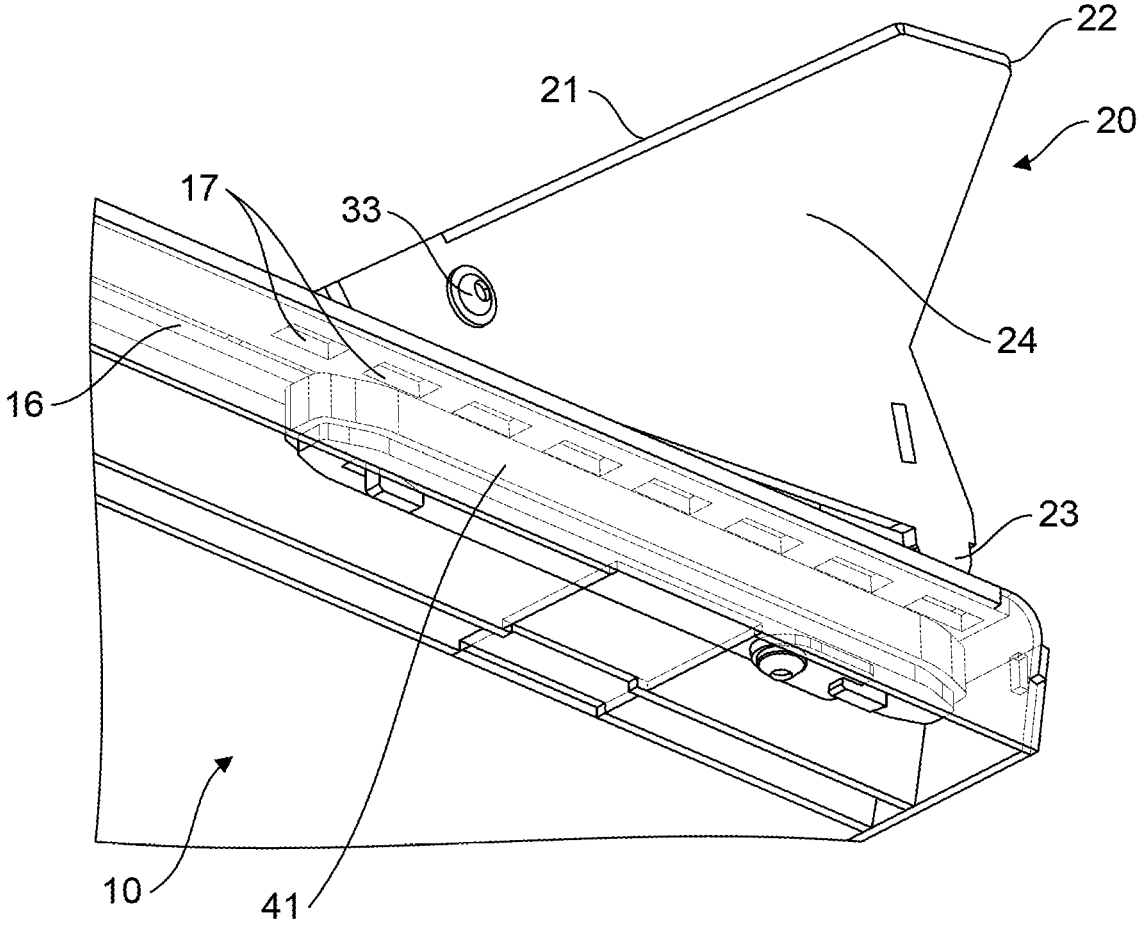
FIG. 15 is a bottom, side perspective view, in partial cross-section, of the embodiment illustrated in FIG. 10, showing the adjustable track start wedge in an unlocked position.
Figure 16:
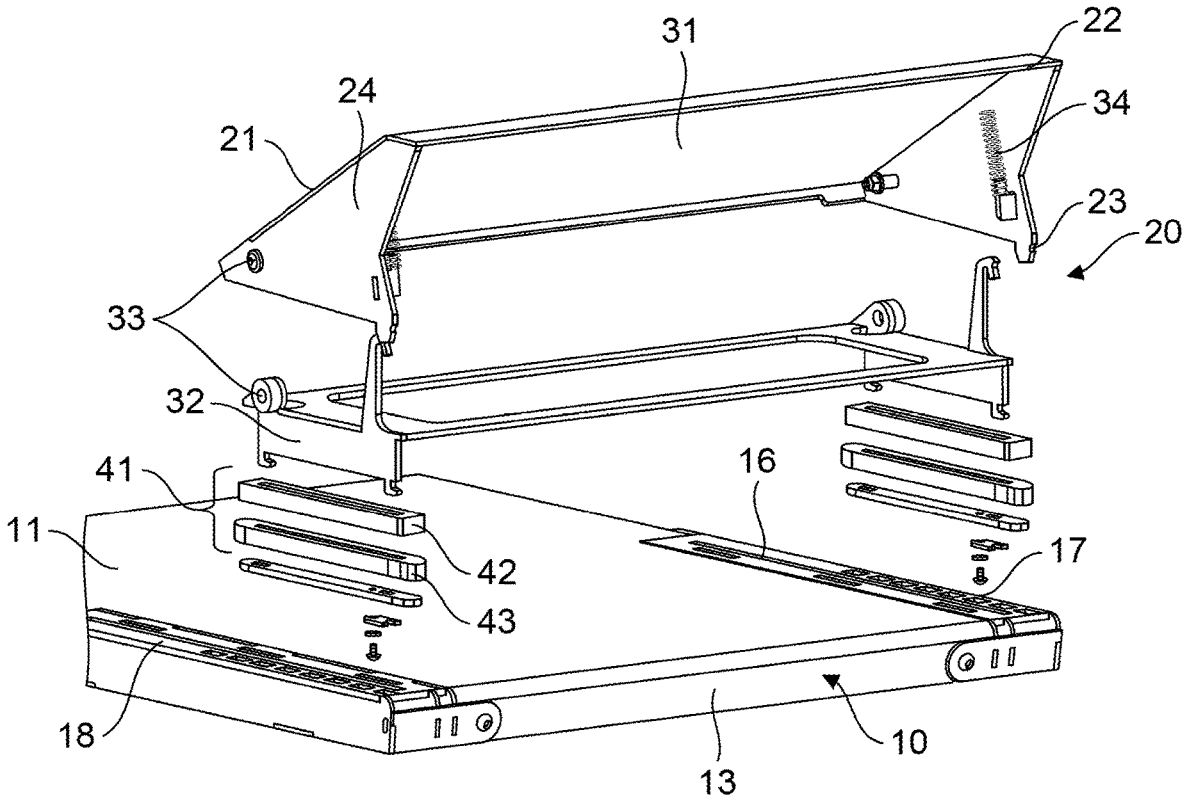
FIG. 16 is an exploded side, rear perspective view of the embodiment illustrated in FIG. 10, showing the various components by which the adjustable track start wedge is connected to the swimming start block.
Figure 17:
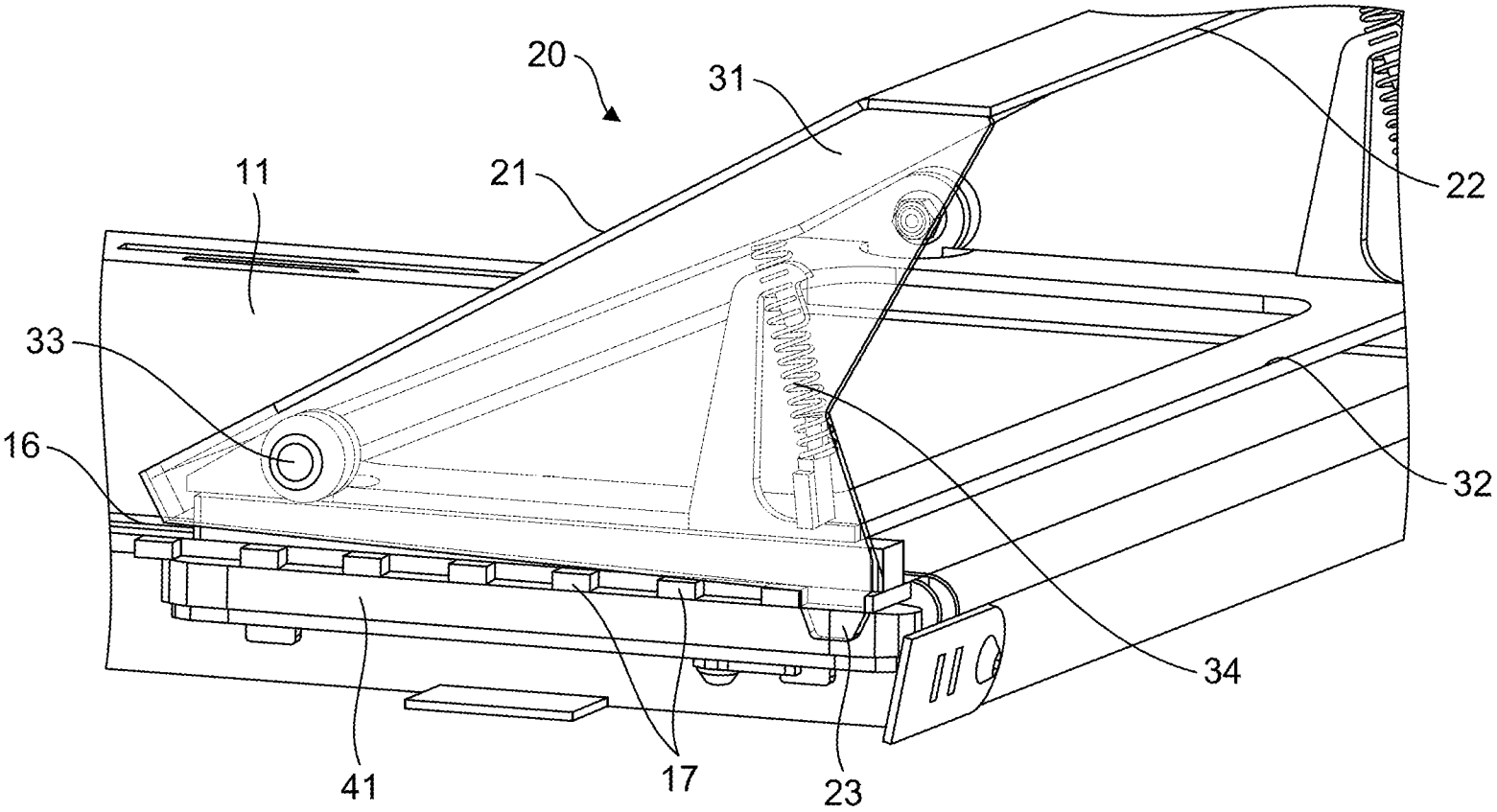
FIG. 17 is a side perspective view, in partial cross-section, of the embodiment illustrated in FIG. 10, showing the adjustable track start wedge in a locked position.

A swimming start block assembly 100 mounted to a support post as it would typically be positioned at the end of a pool for a competitive and/or timed swimming event in accordance with the present disclosure is shown in FIG. 1. For the rest of the Figures, only the swimming start block assembly 100 and not the supporting structure is shown.

A first embodiment of a swimming start block assembly 100 in accordance with the present disclosure is shown in FIGS. 2-9. A second embodiment of a swimming start block assembly 100 in accordance with the present disclosure is shown in FIGS. 10-17. Both embodiments share many features in common, with applicable reference numbers being used in common between the two embodiments.

The swimming start block assembly 100 includes a swimming start block 10 having an upper surface 11, a front edge 12, a rear edge 13, and first and second side edges 14, 15. The swimming start block 10 may be made of any of a variety of materials, including for example metal, e.g. stainless steel; fiberglass; plastic, e.g. polypropylene; glass-filled plastic, e.g. glass-filled polypropylene; etc. The upper surface 11 may also comprise an anti-skid material, including for example an abrasive grip tape, such as that sold by 3M™ under the name Safety Walk™; textured rubber; or abrasive grit; the latter two of which may be applied with resins or adhesives for instance. As shown in the illustrated embodiments, the swimming start block 10 may have a generally rectangular shape, though other shapes are contemplated without departing from the scope of the present disclosure. Moreover, though the swimming start block 10 is shown as having a consistent height, in some embodiments, the upper surface 11 may be inclined such that the rear edge 13 is at a higher elevation than the front edge 12.

The upper surface 11 of the swimming start block 10 includes, along each of the first and second sides, a track 16 and a plurality of apertures 17. In some embodiments, such as the illustrated embodiments, the track 16 and the plurality of apertures 17 may be part of a surface plate 18 that is attached to the swimming start block 10. As can best be seen in FIG. 8, for instance, the upper surface 11 of the start block 10 may include an opening 19 into which the surface plate 18 is at least partially inserted. This provides for an easy installation and/or removal of the track start wedge block 20. In other embodiments, however, the track 16, the plurality of apertures 17, or both may be manufactured directly into the swimming start block 10 itself.

The plurality of apertures 17 are aligned along an axis that runs between the front edge 12 and the rear edge 13 of the swimming start block 10. Each aperture 17 is configured to receive a locking tab of the track start wedge 20. In some embodiments, the apertures 17 that run along each side of the upper surface 11 may be spaced apart a distance that is less than the width of the locking tab of the track start wedge 20. This may facilitate ensuring that the track start wedge 20 is locked in place regardless of where along the front-to-rear axis it is released.

The swimming start block assembly 100 further includes a track start wedge 20. The track start wedge 20 is positioned on the rear half of the upper surface 11 of the start block 10 and is adjustable in a frontward and rearward direction so that a swimmer can position it at a desired location along the front-rear axis. The track start wedge includes an angled front surface 21 that is sized and configured for a swimmer to put his or her rear foot when taking a track start position to start a competitive swimming event or when practicing for such an event. The angled front surface 21 starts adjacent to the upper surface 11 and extends upward and rearward to a top, rear edge 22. As shown in the illustrated embodiments, the angled front surface 21 may have an upper portion that extends rearward a short distance to the top, rear edge 22. In other embodiments, however, the angled front surface may be a single continuous surface that extends from adjacent the upper surface 11 of the start block to the top, rear edge 22.

The track start wedge 20 may be made of any of a variety of materials, including for example metal, e.g. stainless steel; fiberglass; plastic, e.g. polypropylene; glass-filled plastic, e.g. glass-filled polypropylene; etc. If materials other than metal are used, then at least some metal structural components may be included in addition to the wedge material. The angled front surface 21 of the track start wedge may also comprise an anti-skid material, including for example an abrasive grip tape, such as that sold by 3M™ under the name Safety Walk™; textured rubber; or abrasive grit; the latter two of which may be applied with resins or adhesives for instance. In order to provide a swimmer with a consistent surface for his or her feet, the anti-skid material on the angled front surface 21 of the track start wedge 20 may desirably be the same anti-skid material that is on the upper surface 11 of the start block 10.

The track start wedge 20 has, along each side, one or more locking tabs 23. Each locking tab 23 extends in a downward direction and is configured to be received by one of the apertures 17 that run along the same side of the upper surface 11 of the start block 10. In the illustrated embodiments, the track start wedge 20 has a single locking tab 23 along each side, for a total of two locking tabs. However, other (non-illustrated) embodiments are contemplated that utilize more than one locking tab 23 along each side. In some embodiments, such as that illustrated in FIGS. 10-17, the one or more locking tabs 23 may extend downward from a sidewall 24 of the wedge. In other embodiments, such as that illustrated in FIGS. 2-9, the one or more locking tabs 23 may extend downward from a side portion of a movable element 31 that is positioned adjacent to, and desirable inward from, the sidewall 24 of the wedge.

Each locking tab 23 is sized and configured to be received by any of the apertures 17 of the upper surface 11 of the start block 10. In some embodiments, each locking tab 23 may have a front edge 24, a rear edge 25, or both that are tapered inward toward the bottom of the tab. In the illustrated embodiments, the locking tabs 23 each have both an inward tapering front edge 24 and an inward tapering rear edge 25. By providing the locking tabs 23 with inward tapering front and rear edges 24, 25, if the locking tab 23 is not vertically aligned with an aperture 17 when the track start wedge 20 is moved from an unlocked position to a locked position, a tapered edge of the tab will interact with the surface (with which it is vertically aligned) adjacent the aperture to guide the locking tab into the aperture. When combined with careful spacing of the apertures 17 and spring loading, as described herein, this can ensure that the locking tab 23 fully enters an aperture regardless of whether or not the tab is aligned with an aperture when the track start wedge 20 is moved from an unlocked to a locked position. Additionally or alternatively, the surfaces adjacent each of the apertures 17 may be tapered toward the aperture to guide the locking tab 23 into place regardless of whether or not the locking tab 23 is vertically aligned with the aperture when the track start wedge 20 is moved to a locked position.

The track start wedge 20 also has, along each side, one or more carriages 41. Each of the carriages 41 is configured to slide along the track 16 that is positioned on the associated side of the upper surface 11 of the start block 10 in a forward and rearward direction. In the illustrated embodiments, the track start wedge 20 has a single carriage 41 along each side, for a total of two carriages. However, other (non-illustrated) embodiments are contemplated that utilize more than one carriage 41 along each side.

As shown in the illustrated embodiments, each carriage 41 may comprise an element that slides along track 16 that is little more than a flat surface. In the illustrated embodiments, for instance, each carriage 41 comprises an upper element 42 that is configured to slide along a top surface of the track 16 and a lower element 43 that is configured to slide along a bottom surface of the track. Each of the upper and lower elements 42, 43 may comprise a material that produces relatively little friction and that is strong enough to withstand many repetitions of the sliding motion. In some embodiments, for instance, the upper and lower elements 42, 43 of the carriage may be made of or may have surfaces made of a low-friction plastic, such as ultra-high molecular weight polyethylene or the like.

By providing upper and lower carriage elements 42, 43 that sandwich the track 16 or a portion of the track, undesirable up and down movement, e.g. wobbling, of the track start wedge 20 may be prevented or minimized. Similarly, the outer-facing sidewall, the inner-facing sidewall, or both of at least one of the upper and lower carriage elements 42, 43 may be configured to slidably contact a surface so as to prevent or minimize undesirable side-to-side movement, e.g. wobbling, of the track start wedge 20. In the illustrated embodiments, for instance, the inner-facing sidewall of the lower carriage element 43 slidably contacts a downward extending plate of the surface plate 18 that contains the track 16 and the plurality of apertures 17. By providing such a contact on each side of the track start wedge 20, undesired movement of the track start wedge 20 toward both the first and second sides 14, 15 of the track start block 10 may be reduced or prevented.

In other, non-illustrated embodiments, the carriage 41 may be configured to slide along and optionally inside a track via any of a variety of mechanisms that would be understood by persons skilled in the art. For instance, in some embodiments, the carriage may include one or more drawer slides, one or more rollers (e.g. wheels, ball bearings, etc.), one or more guides, one or more linear bearings, one or more bushings, or any combination thereof.

The one or more carriages 41 along each side of the track start wedge 20 allow for forward and rearward movement of the track start wedge along the swimming start block 10 and the one or more locking tabs 23 along each side of the track start wedge allow a user to secure the track start wedge at a desired front-to-rear position on the start block. In order to alter the track start wedge 20 between an unlocked position in which it is slidable along the tracks 16 of the start block 10 and a locked position in which the locking tabs 23 are received in the apertures 17 of the start block, the track start wedge 20 comprises a vertically movable element 31 and a vertically fixed element 32.

The vertically movable element 31 comprises the locking tabs 23, such that an upward movement of the vertically movable element 31 removes the locking tabs 23 from the associated apertures 17 along the sides of the upper surface 11 of the start block 10 and downward movement of the vertically movable element inserts the locking tabs into the associated apertures along the sides of the upper surface of the start block. The vertically fixed element 32 comprises or is connected to the one or more carriages 41, such that the carriages 41 have a constant contact with the tracks 16 on which they slide and thus movement of the track start wedge 20 along the front-to-rear axis is consistent and reliable.

The vertically movable element 31 is pivotably connected to the vertically fixed element 32 at a pivot point 33. The pivot point 33 is located at an end opposite the locking tabs 23. In the illustrated embodiments, the locking tabs 23 are located at the rear end of the track start wedge 20 and the pivot point 33 is located at the front end of the track start wedge. The vertically movable element 31 can be pivoted (i) upward, or more particularly upward and forward, to remove the locking tabs 23 from the apertures 17 and thereby allow for sliding of the track start wedge 20 in a front or rear direction along the tracks 16 or (ii) downward, or more particularly downward and rearward, to position the locking tabs in the apertures and thereby lock the track start wedge in place at a desired position along the front-to-rear axis.

The vertically movable element 31 may be spring-loaded toward the locked position. As shown in the illustrated embodiments, for instance, the track start wedge 20 may include one or more springs 34 that bias the vertically movable element 31 downward, or more particularly downward and rearward. In the illustrated embodiments, the track start wedge 20 comprises a spring 34 along each side, for a total of two springs. However, a greater or lesser number of springs are contemplated, as is the use of different types of springs. Each of the springs 34 spans between the vertically movable element 31 and a stop on the vertically fixed element 32. The tension of the one or more springs 34 may be selected to provide the track start wedge 20 with a biasing force that is strong enough to ensure that the locking tabs 23 are fully inserted into the associated apertures 17 but light enough that the spring can easily be compressed by a swimmer to bring the track start wedge into the unlocked position.

The particular arrangement of the vertically movable element 31 and the vertically fixed element 32 may vary. In the embodiment illustrated in FIGS. 2-9 for instance, the angled front surface 21 of the track start block 20 is part of the vertically fixed element 32. The vertically movable element 31 is positioned underneath and/or rearward of the angled front surface 21 and comprises a bar 35 that spans between and connects two side elements 36, with the bottom edge of each of the side elements 36 comprising a locking tab 23. The bar 35 is positioned so that it can be accessed by a swimmer standing on the upper surface 11 of the start block 10 and pulled upward, or more particularly upward and forward, to move the locking tabs 23 out of the apertures 17, thus bringing the track start wedge 20 to an unlocked position. At the same time, the bar 35 is positioned so that it is out of the way and does not interfere with the swimmer's start of a swim race.

The bar 35 may include one or more lift tabs 37 that extend from the bar and which are configured to be grasped by a swimmer standing on the upper surface 11 of the start block 10 in order to manipulate the bar upward, or more particularly upward and forward. The lift tabs 37 may take on any of a variety of shapes. For instance, though illustrated as solid tabs, the lift tabs 37 may alternatively have one or more apertures for receiving a user's finger or fingers.

The lift tabs 37 may be positioned at a variety of different locations. In the illustrated embodiment, for instance, the bar includes a lift tab 37 that is positioned substantially centrally between the first and second side elements 36 (and also substantially centrally between the first and second side edges 14, 15 of the start block 10). The bar 35 also includes a pair of first and second lift tabs 37 that are positioned at the ends of the bar and which extend laterally outward from the first and second side elements 36. These lift tabs 37 may also extend laterally beyond the sidewalls 24 of the track start wedge 20 to have increased visibility to a swimmer standing on the upper surface 11 of the start block 10. Regardless of the location of the lift tab or tabs 37, each lift tab is configured to facilitate grasping and manipulation of the bar 35 to bring the track start wedge 20 to an unlocked position in which it can be slid forward or rearward to a desired position.

In the embodiment illustrated in FIGS. 10-17, on the other hand, the angled front surface 21 of the track start wedge 20 is part of the vertically movable element 31. In that embodiment, the locking tabs 23 are located at the bottom edges of the sidewalls 24 of the track start wedge 20. In such an embodiment, a swimmer may bring the track start wedge 20 into an unlocked position by grasping the top, rear edge 22 of the angled front surface 21 and pulling upward, or more particularly upward and forward, to thereby rotate the vertically movable element 31 about the vertically fixed element 32 and raise the locking tabs 23 out of the apertures 17 on the upper surface 11 of the start block 10. Though not illustrated, the upper, rear edge 22 of the track start wedge 20 may comprise one or more lift tabs, handles, or the like, to give a visual indication to a swimmer that the wedge can be lifted and adjusted.

It can be seen that the described embodiments provide a unique and novel swimming starting block assembly 100 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A swimming starting block assembly comprising:

a starting block having an upper surface configured for a swimmer to stand on at the start of a competitive swimming event, the starting block having a front edge, a rear edge, a first side edge, and a second side edge;

a track start wedge that is slidable along the upper surface along an axis running between the front edge and the rear edge and lockable at a plurality of distances from the front edge;

wherein the upper surface comprises, along each of the first and second sides:

a plurality of apertures aligned along the axis, each of the plurality of apertures being configured to receive a locking tab of the track start wedge; and a track along which a carriage of the track start wedge is configured to slide; and wherein the track start wedge comprises an angled front surface configured for the swimmer to place one of his/her feet and, along each of its sides:

a carriage configured to slide along the track in a frontward and rearward direction; and a locking tab configured to prevent sliding of the track start wedge when received by one of the plurality of apertures.

2. The swimming starting block assembly of claim 1, wherein the track start wedge comprises a vertically fixed element and a vertically movable element;

wherein the vertically movable element comprises the locking tabs and the vertically fixed element comprises or is connected to the carriage; and wherein the vertically movable element is pivotably connected to the vertically fixed element at an end opposite the locking tabs, such that the vertically movable element can be pivoted (i) upward to remove the locking tabs from the apertures and thereby allow for sliding of the track start wedge or (ii) downward to position the locking tabs in the apertures and thereby lock the track start wedge in place at a desired position.

3. The swimming starting block assembly of claim 2, wherein the angled front surface is part of the vertically fixed element and the vertically movable element is a bar positioned below the angled front surface.

4. The swimming starting block assembly of claim 3, wherein the vertically movable element comprises one or more lift tabs configured to be grasped and manipulated by a swimmer in order to pivot the vertically movable element upward.

5. The swimming starting block assembly of claim 4, wherein the one or more lift tabs comprise a tab that is positioned substantially centrally between the first and second side edges.

6. The swimming starting block assembly of claim 4, wherein the one or more lift tabs comprises first and second tabs, which extend laterally beyond the sides of the angled front surface.

7. The swimming starting block assembly of claim 2, wherein the angled front surface is part of the vertically movable element.

8. The swimming starting block assembly of claim 2, wherein the vertically movable element is spring-loaded toward the downward position.

9. The swimming starting block assembly of claim 8, wherein the starting block is configured so that each of the locking tabs is received by one of the apertures regardless of where it pivots to the downward position.

10. The swimming starting block assembly of claim 8, wherein each of the locking tabs has angled front and/or rear edges.

11. The swimming starting block assembly of claim 10, wherein distance between adjacent apertures is less than the width of each of the locking tabs.

12. The swimming starting block assembly of claim 1, wherein each carriage comprises an upper element positioned above the track and a lower element positioned below the track.

13. The swimming starting block assembly of claim 12, wherein a side surface of the lower element of each carriage contacts a plate to limit side-to-side movement of the track start wedge.

14. The swimming starting block assembly of claim 1, wherein a surface element comprising the track and the plurality of apertures is affixed to the upper surface of the starting block along each of the first and second sides.

15. The swimming starting block assembly of claim 14, wherein the upper surface of the starting block comprises, along each of the first and second sides, an opening configured to at least partially receive the surface element.

16. The swimming starting block assembly of claim 1, wherein the assembly is configured so that the track start wedge is never physically removed from the starting block when adjusting its position.

17. The swimming starting block assembly of claim 1, wherein the upper surface of the starting block and the front angled surface of the track start wedge are provided with an anti-skid material.

18. The swimming starting block assembly of claim 1, further comprising a mounting unit which supports the swimming starting block in an elevated position.

19. The swimming starting block assembly of claim 1, wherein the track start wedge is lockable in at least six different positions.

* * * * *